US011673174B2

(12) United States Patent
Doi et al.

(10) Patent No.: US 11,673,174 B2
(45) Date of Patent: Jun. 13, 2023

(54) BRIDLE DEVICE, METHOD FOR CONTROLLING SNAKING OF STEEL STRIP, AND METHOD FOR PRODUCING STEEL STRIP

(71) Applicant: JFE STEEL CORPORATION, Tokyo (JP)

(72) Inventors: Takashi Doi, Tokyo (JP); Shoji Kasai, Tokyo (JP); Teruhiko Tobe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 17/289,923

(22) PCT Filed: Oct. 16, 2019

(86) PCT No.: PCT/JP2019/040557
§ 371 (c)(1),
(2) Date: Apr. 29, 2021

(87) PCT Pub. No.: WO2020/090453
PCT Pub. Date: May 7, 2020

(65) Prior Publication Data

US 2022/0001429 A1 Jan. 6, 2022

(30) Foreign Application Priority Data

Nov. 2, 2018 (JP) ..... JP2018-207075

(51) Int. Cl.
*B21B 37/68* (2006.01)
*B21B 39/08* (2006.01)
(Continued)

(52) U.S. Cl.
CPC ..... *B21B 37/68* (2013.01); *B21B 39/082* (2013.01); *C21D 8/1222* (2013.01); *C21D 9/562* (2013.01); *B21B 2273/04* (2013.01); *C21D 6/008* (2013.01)

(58) Field of Classification Search
CPC ..... B21B 39/02; B21B 39/08; B21B 39/082; B21B 37/68; B21B 2273/04; B65G 15/14; B65G 21/12
See application file for complete search history.

(56) References Cited

U.S. PATENT DOCUMENTS 4,745,790 A * 5/1988 Teshiba ..... B21B 37/68 72/247
2003/0066857 A1 4/2003 Umlauf
(Continued)

FOREIGN PATENT DOCUMENTS

EP 2 933 032 A1 10/2015
EP 3 216 537 A2 9/2017
(Continued)

OTHER PUBLICATIONS

JP-59085314-A with English abstract, pp. 1-4. (Year: 1982).*
(Continued)

*Primary Examiner* — Teresa M Ekiert
(74) *Attorney, Agent, or Firm* — Oliff PLC

(57) ABSTRACT

A bridle device and a method for producing a steel strip in which snaking of a steel strip that occurs during production of a high-silicon steel strip is suppressed. The bridle device includes a pair of upper and lower rotatable endless belts or a pair of upper and lower rotatable caterpillars configured to pinch a steel strip. The bridle device is movable or swingable in a steel strip width direction by using a steering mechanism. The bridle device further includes a rolling reduction mechanism configured to perform rolling reduction on a pinched portion of the steel strip by using the pair of upper
(Continued)

and lower endless belts or the pair of upper and lower caterpillars. The steering mechanism moves or swings the bridle device in the steel strip width direction, and the rolling reduction mechanism performs rolling reduction on one of end portions in the steel strip width direction.

12 Claims, 4 Drawing Sheets

(51) Int. Cl.

| | |
|---|---|
| ***C21D 8/12*** | (2006.01) |
| ***C21D 9/56*** | (2006.01) |
| *C21D 6/00* | (2006.01) |

(56) References Cited

U.S. PATENT DOCUMENTS

| | | | |
|---|---|---|---|
| 2014/0260481 | A1 | 9/2014 | Umlauf |
| 2017/0260005 | A1 | 9/2017 | Eichner et al. |

FOREIGN PATENT DOCUMENTS

| | | | |
|---|---|---|---|
| JP | S62-227078 | A | 10/1987 |
| JP | H08-002759 | A | 1/1996 |
| JP | H10-219419 | A | 8/1998 |
| JP | H11-043248 | A | 2/1999 |
| JP | 2003053411 | A | 2/2003 |
| JP | 2006-257493 | A | 9/2006 |
| RU | 2004113028 | A | 10/2005 |
| SU | 310703 | A1 | 8/1971 |
| SU | 1044367 | A1 | 9/1983 |
| SU | 1355635 | A1 | 11/1987 |
| WO | 0027554 | A1 | 5/2000 |

OTHER PUBLICATIONS

Jun. 18, 2021 Extended European Search Report issued in European Patent Application No. 19880525.1.

Sep. 22, 2021 Office Action issued in Russian Patent Application No. 2021112519.

Dec. 24, 2019 International Search Report issued in International Patent Application No. PCT/JP2019/040557.

May 20, 2022 Office Action issued in Chinese Patent Application No. 201980071911.4.

Jan. 11, 2023 Office Action issued in Chinese Patent Application No. 201980071911.4.

* cited by examiner

BRIDLE DEVICE, METHOD FOR CONTROLLING SNAKING OF STEEL STRIP, AND METHOD FOR PRODUCING STEEL STRIP

TECHNICAL FIELD

This application relates to a bridle device used for a production device for a high-silicon steel strip by using a gas siliconizing method. The application also relates to a method for controlling snaking of a steel strip and a method for producing a steel strip that control snaking of the steel strip by using the bridle device.

BACKGROUND

As a method for industrially producing a high-silicon steel sheet, for example, a method for producing by using a gas siliconizing method as presented in Patent Literature 1 is known. In this method for producing, a series of processes are performed in a continuous line as follows: causing Si to permeate by heating a steel strip having a relatively low Si concentration and performing siliconizing treatment in an atmosphere with a non-oxidizing gas containing a silicon chloride gas; performing next diffusion treatment to diffuse the Si in the thickness direction; and coiling the steel strip into a coil shape after cooling. Thus, a high-silicon steel strip can be efficiently produced.

A continuous siliconizing treatment facility for producing a high-silicon steel strip is a horizontal continuous furnace and required to treat the steel strip at a high temperature of higher than or equal to 1000° C. Accordingly, there is a problem in that swelling of the steel strip is likely to occur. Particularly, in a siliconizing treatment zone in the continuous siliconizing treatment facility, as Si is added to the steel strip by a siliconizing reaction, the lattice constant of the steel strip gradually varies and the steel strip shrinks. Thus, when a distribution of the Si adding amount varies in a steel strip width direction, there is a variation in shrinkage in the steel strip width direction, and accordingly, a phenomenon in which the length in the steel strip width direction varies occurs. As a result, the steel strip is partly cambered, and, compared to the case where a low-silicon steel sheet is rolled at the same temperature, a snaking amount of the steel strip increases.

Regarding the problem as described above, it is conceivable that snaking of the high-silicon steel strip can be prevented by applying a method of, for example, Patent Literature 2.

CITATION LIST

Patent Literature

PTL 1: Japanese Unexamined Patent Application Publication No. 62-227078

PTL 2: Japanese Unexamined Patent Application Publication No. 10-219419

SUMMARY

Technical Problem

However, as efficiency of the continuous siliconizing treatment facility that produces a high-silicon steel strip increases, a snaking correction capability cannot be sufficiently exhibited in some cases. In order to improve the snaking correction capability, it is conceivable that a movement amount or swinging amount is increased in the steel strip width direction. However, this increases a torsion applied to the high-silicon steel strip, and accordingly, there may be cracking in edge portions of the steel strip and, in the worst case, the steel strip may break.

The disclosed embodiments are made in view of the above described situation, and an object of the disclosed embodiments is to provide a bridle device and a method for producing a steel strip with which snaking of a steel strip that occurs during production of a high-silicon steel strip is suppressed even at a higher line speed than that of the related art (about 20 mpm), thereby enabling the steel strip to be more efficiently produced.

Solution to Problem

As a result of a dedicated study made by the inventors, regarding a bridle device disposed at an exit of a siliconizing treatment zone, it has been found that, when a rolling reduction amount is made nonuniform in the width direction in pinching a steel strip in combination with the related-art technique of a movement or swinging in the width direction, snaking of the steel strip can be corrected to a side where the rolling reduction amount is high, and accordingly, a higher snaking correction effect can be exhibited.

The disclosed embodiments are based on the above-described findings, and the gist of these embodiments is as follows.

[1] A bridle device which includes a pair of upper and lower rotatable endless belts or a pair of upper and lower rotatable caterpillars configured to pinch a steel strip. The bridle device is movable or swingable in a steel strip width direction by using a steering mechanism.

The bridle device further includes a rolling reduction mechanism configured to perform rolling reduction on a pinched portion of the steel strip by using the pair of upper and lower endless belts or the pair of upper and lower caterpillars.

Based on a steering amount and a rolling reduction amount determined in accordance with a snaking amount of the steel strip, the steering mechanism moves or swings the bridle device in the steel strip width direction, and the rolling reduction mechanism performs rolling reduction on one of end portions in the steel strip width direction of the steel strip.

[2] In the bridle device described in [1], the rolling reduction mechanism performs rolling reduction on one of the end portions in the steel strip width direction of the steel strip so as to increase the rolling reduction amount in a direction opposite to a snaking direction of the steel strip.

[3] In the bridle device described in [1] or [2], a ratio of the rolling reduction amount to the steering amount is set to 1.5 times to 2.5 times.

[4] In a method for controlling snaking of a steel strip, snaking of the steel strip is controlled by using the bridle device described in any one of [1] to [3].

[5] In a method for producing a steel strip, the steel strip is produced by using the bridle device described in any one [1] to [3].

Advantageous Effects

According to the disclosed embodiments, even at a higher line speed than that of the related art, snaking of the steel strip that occurs when the high-silicon steel strip is produced can be suppressed, and the steel strip can be produced with higher efficiency.

DETAILED DESCRIPTION

Figure 1:
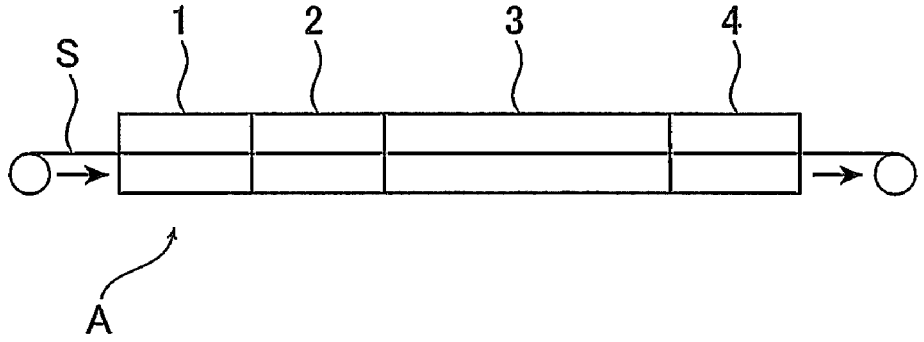
FIG. 1 is a schematic view of a continuous siliconizing treatment facility that performs siliconizing treatment on high-silicon steel strips.

FIG. 1 is a schematic view of a continuous siliconizing treatment facility that performs siliconizing treatment on high-silicon steel strips. The continuous siliconizing treatment facility includes a horizontal continuous furnace A. Typically, the continuous furnace A is provided with a heating zone 1, a siliconizing zone 2, a diffusion and soaking zone 3, and a cooling zone 4 arranged from an entrance side in the furnace. In such a continuous furnace A, a steel strip S is introduced into and passed through the furnace (an arrow in FIG. 1 indicates a passing direction of the steel strip S) and heated to or around a siliconizing treatment temperature (1023 to 1200° C.) in the heating zone 1, and then brought into contact with a treatment gas that contains a silicon chloride gas such as $SiCl_4$ in the siliconizing zone 2. Typically, the treatment gas is blown from gas nozzles toward both surfaces of the steel strip so as to cause Si to permeate the surfaces of the steel strip S, and then, diffusion heat treatment is performed in the diffusion and soaking zone 3 so as to diffuse the Si in a plate thickness direction. After that, the steel strip S is cooled in the cooling zone 4 and the siliconizing treatment ends. The steel strip S exits through furnace exit side. A bridle device according to the disclosed embodiments is installed on an exit side of the continuous furnace A, that is, behind the cooling zone 4.

The bridle device according to the disclosed embodiments includes a pair of upper and lower endless belts or caterpillar members and a holding mechanism. The endless belts or caterpillar members pinch the steel strip and are rotatable. The holding mechanism is for holding the upper endless belt or the upper caterpillar member and performing rolling reduction on the steel strip. In the bridle device according to the disclosed embodiments, parts of the pair of upper and lower rotating endless belts or caterpillar members are guided by a steering mechanism so as to move in the steel strip width direction (move horizontally) on a steel strip pass line and these horizontally moving portions pinch the steel strip while being brought into surface contact with both the surfaces of the steel strip. Hereafter, the bridle device according to the disclosed embodiments is described with reference to the drawings.

Figure 2:
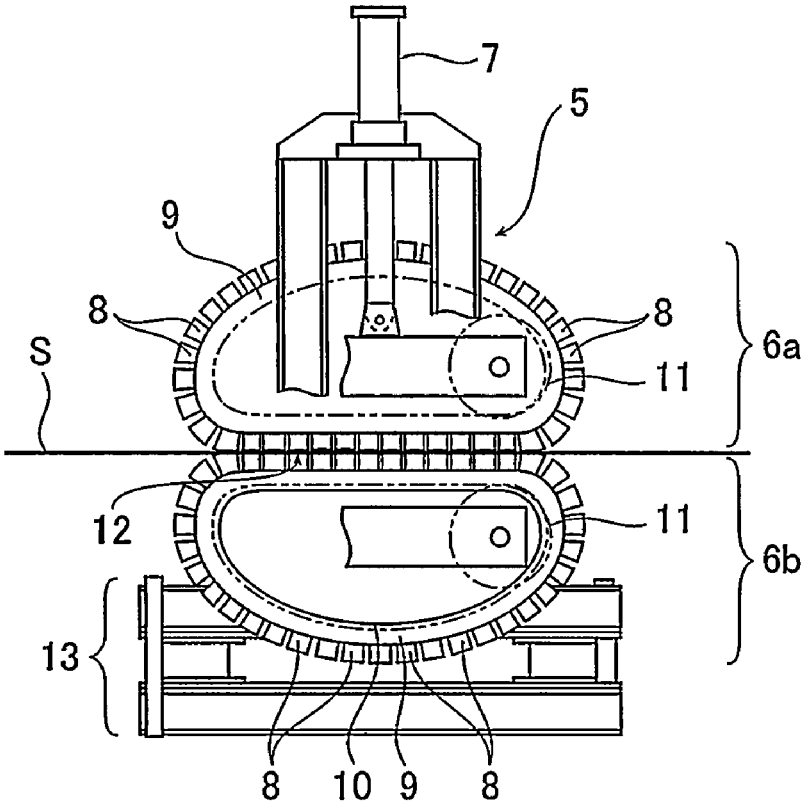
FIG. 2 is a side view of a bridle device according to an embodiment.

FIG. 2 is a side view of the bridle device according to an embodiment. In FIG. 2, a bridle device 5 includes a pair of upper and lower caterpillar members 6*a*, 6*b*, a holding mechanism 7 (cylinder device or the like), and a drive device (not illustrated). The caterpillar members 6*a*, 6*b* pinch the steel strip S. The holding mechanism 7 is for holding the upper caterpillar member 6*a* and performing rolling reduction on the steel strip S. The drive device rotates the pair of upper and lower caterpillar members 6*a*, 6*b*. The upper and lower caterpillar members 6*a*, 6*b* each include a chain belt 9 formed by connecting many rectangular segments 8. An annular guide mechanism 10 for holding the chain belt 9 is provided inside each of the chain belts 9 (In FIG. 2, the guide mechanism 10 is illustrated only for the lower caterpillar member 6*b*). A sprocket wheel 11 that drives the chain belt 9 is provided at one end inside each of the caterpillar members 6*a*, 6*b*. Thus, the caterpillar members 6*a*, 6*b* are driven by the respective sprocket wheels 11 and circulate along the guide mechanisms 10. Furthermore, a rubber coating layer (not illustrated) is formed on an upper surface of each of the segments 8. The main body of the bridle device 5 is supported by a frame 13.

The annular guide mechanism 10 is configured such that, in a caterpillar circumferential direction, a steel strip pinching portion is linearly formed and portions other than the steel strip pinching portion are held in appropriate shapes such as arcuate shapes. Thus, in steel strip pinching parts of the upper and lower caterpillar members 6*a*, 6*b*, a plurality of the segments 8 can horizontally move with end portions of the segments 8 being in contact with each other so as to pinch the steel strip S by using these horizontally moving portions 12. Accordingly, the bridle device 5 can reliably pinch the steel strip S by surface contact, thereby the bridle device 5 can transport the steel strip S and perform a tension isolation function without bending the steel strip S.

Figure 3:
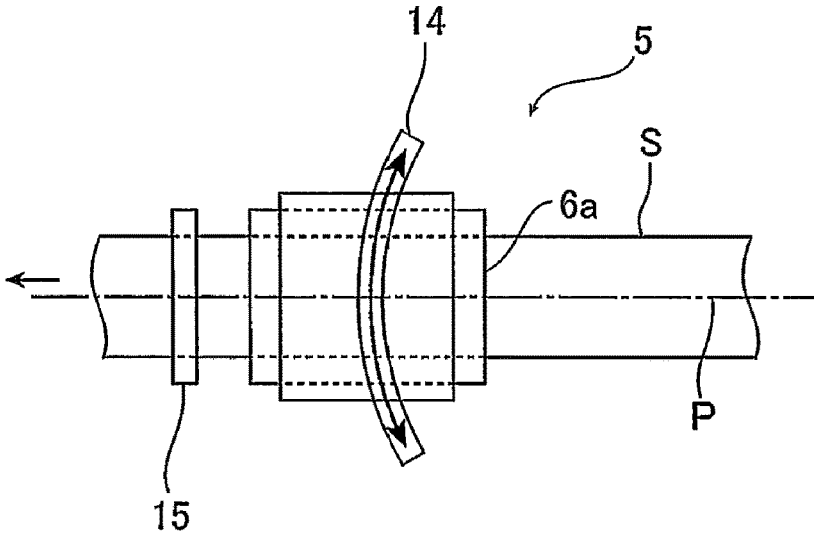
FIG. 3 is a plan view of a steering mechanism of the bridle device according to an embodiment when seen from above.

The bridle device 5 is movable in the steel strip width direction relative to the steel strip pass line. This configures the steering mechanism of the bridle device 5. FIG. 3 is a plan view of the steering mechanism of the bridle device according to an embodiment when seen from above. The steering mechanism of the bridle device 5 is incorporated in the frame 13. As illustrated in FIG. 3, the bridle device 5 according to this embodiment is movably held by a guide 14 (guide rail or the like) provided in the steel strip width direction relative to the steel strip pass line. The guide 14 is formed along an arc about a virtual point P on the continuous furnace side. Accordingly, the bridle device 5 movably held along the guide 14 moves or swings in an arcuate shape about the virtual point P in the steel strip width direction (horizontal direction) in the steel strip pass line.

As illustrated in FIG. 3, a snaking detection device 15 (for example, a position detector including a light transmitter and a light receiver) for the steel strip S is provided immediately behind the bridle device 5. When snaking of the steel strip S is detected by the snaking detection device 15, the steering mechanism performs steering in which the bridle device 5 is moved in the width direction of the steel strip S, thereby correcting the snaking. That is, the bridle device 5 moves the steel strip S in a direction opposite to a direction of snaking of the steel strip S in the steel strip width direction while the steel strip S is pinched by the caterpillar members 6*a*, 6*b*, thereby correcting the snaking of the steel strip S. Regarding a steering amount, snaking of the steel strip S is controlled based on the steering amount and a rolling reduction amount which are to be described later. Instead of the arcuate shape illustrated in FIG. 3, the movement path of the bridle device 5 in the width direction of the steel strip pass line may be a linear shape perpendicular to the steel strip pass line or an arcuate shape directed opposite to the arcuate path illustrated in FIG. 3. In such cases, the configuration of the guide 14 is selected in accordance with the movement path.

The movement of the bridle device 5 according to the disclosed embodiments on the steel strip pass line is performed by a drive force of the drive device (not illustrated; for example, the cylinder device or the like).

Although the device in which a pinching means for the steel strip S is the upper and lower caterpillar members is illustrated in FIGS. 2 and 3, upper and lower endless belts may be used instead of the upper and lower caterpillar members.

The bridle device according to the disclosed embodiments further includes a rolling reduction mechanism that performs rolling reduction on a pinched portion of the steel strip by using the pair of upper and lower endless belts or caterpillar members. Thus, the steering mechanism moves or swings the bridle device in the steel strip width direction based on the rolling reduction amount and the steering amount determined in accordance with a snaking amount of the steel strip, and in addition, the rolling reduction mechanism performs rolling reduction on one end portion in the steel strip width direction so as to increase the rolling reduction amount in the direction opposite to the snaking direction of the steel strip. Thus, in combination with the related-art technique for the steering mechanism to move or swing in the width direction, the rolling reduction amount in pinching the steel strip by the rolling reduction mechanism is made nonuniform in the steel strip width direction. This can enable correction of snaking of the steel strip toward the side where the rolling reduction amount is high. As a result, even in the case where a line speed is higher than that of the related art, a higher snaking correction effect can be produced.

Figure 4:
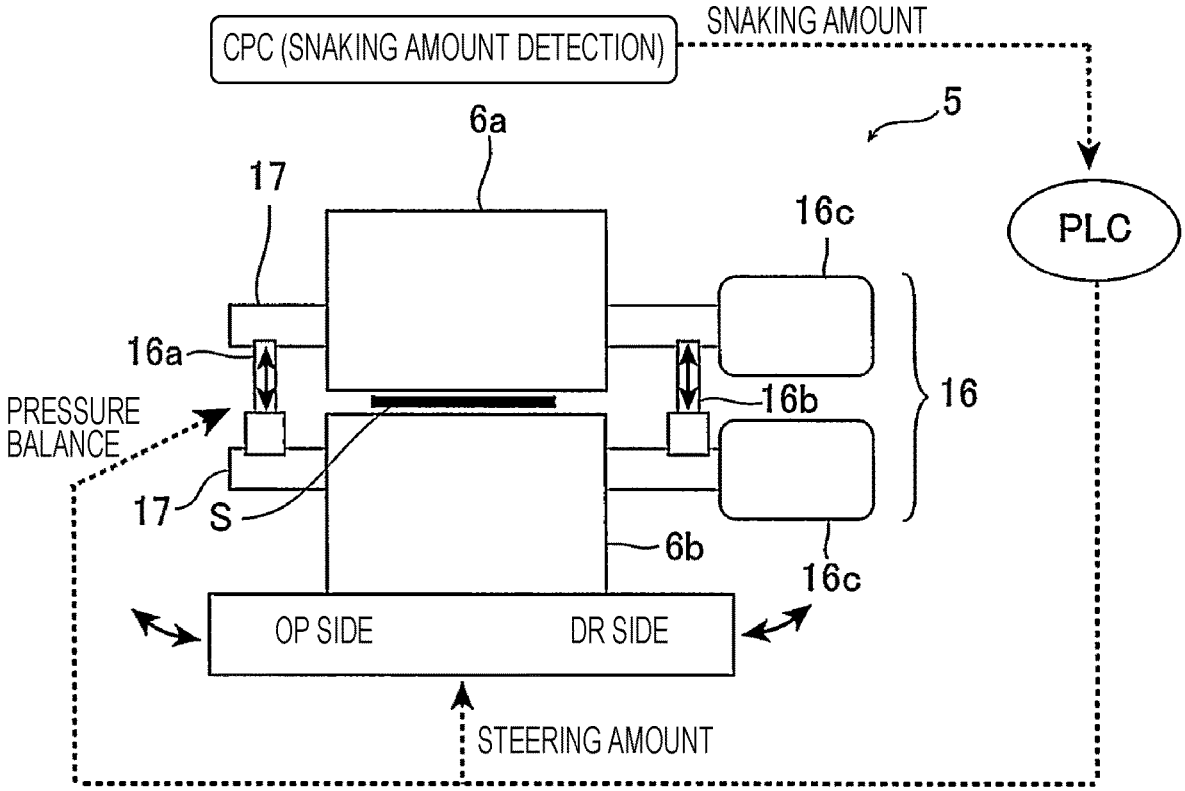
FIG. 4 is a schematic view illustrating a sectional view of a rolling reduction mechanism when seen from front and a control flow of a holding mechanism in the bridle device according to an embodiment.

FIG. 4 is a schematic view illustrating a sectional view of the rolling reduction mechanism when seen from front and a control flow of the holding mechanism in the bridle device according to an embodiment. The bridle device 5 according to this embodiment includes a rolling reduction mechanism 16 for controlling the pressure of the upper caterpillar member 6*a* when the steel strip is pinched. Specifically, hydraulic cylinders 16*a*, 16*b* that move up and down the upper caterpillar member 6*a* are provided on both sides in the steel strip width direction. According to this embodiment, the hydraulic cylinders 16*a*, 16*b* operate so as to perform rolling reduction control. That is, the pressure of the hydraulic cylinder 16*a* on one side in the steel strip width direction and the pressure of the hydraulic cylinder 16*b* on the other side in the steel strip width direction are set to be different from each other, thereby the steel strip S undergoes rolling reduction in a nonuniform manner in the steel strip width direction. The hydraulic cylinders 16*a*, 16*b* are connected to motors 16*c*, and the amount of pressure is appropriately adjusted by the motors 16*c*. Drive shafts 17 are connected to the motors 16*c*.

According to the disclosed embodiments, when snaking of the steel strip S is detected by the snaking detection (CPC) device 15 for the steel strip S provided immediately behind the bridle device 5, balance adjustment of the steering amount and the rolling reduction amount is performed so as to correct the snaking, thereby the snaking is corrected. That is, based on the snaking amount detected by the snaking detection device 15, the steering amount and the rolling reduction amount (pressure balance) are automatically determined in accordance with a control method plan to be described later on PLC. Then, the steering mechanism moves the bridle device in the steel strip width direction based on the determined steering amount, and the rolling reduction mechanism performs rolling reduction on the steel strip based on the determined rolling reduction amount.

Figure 5:
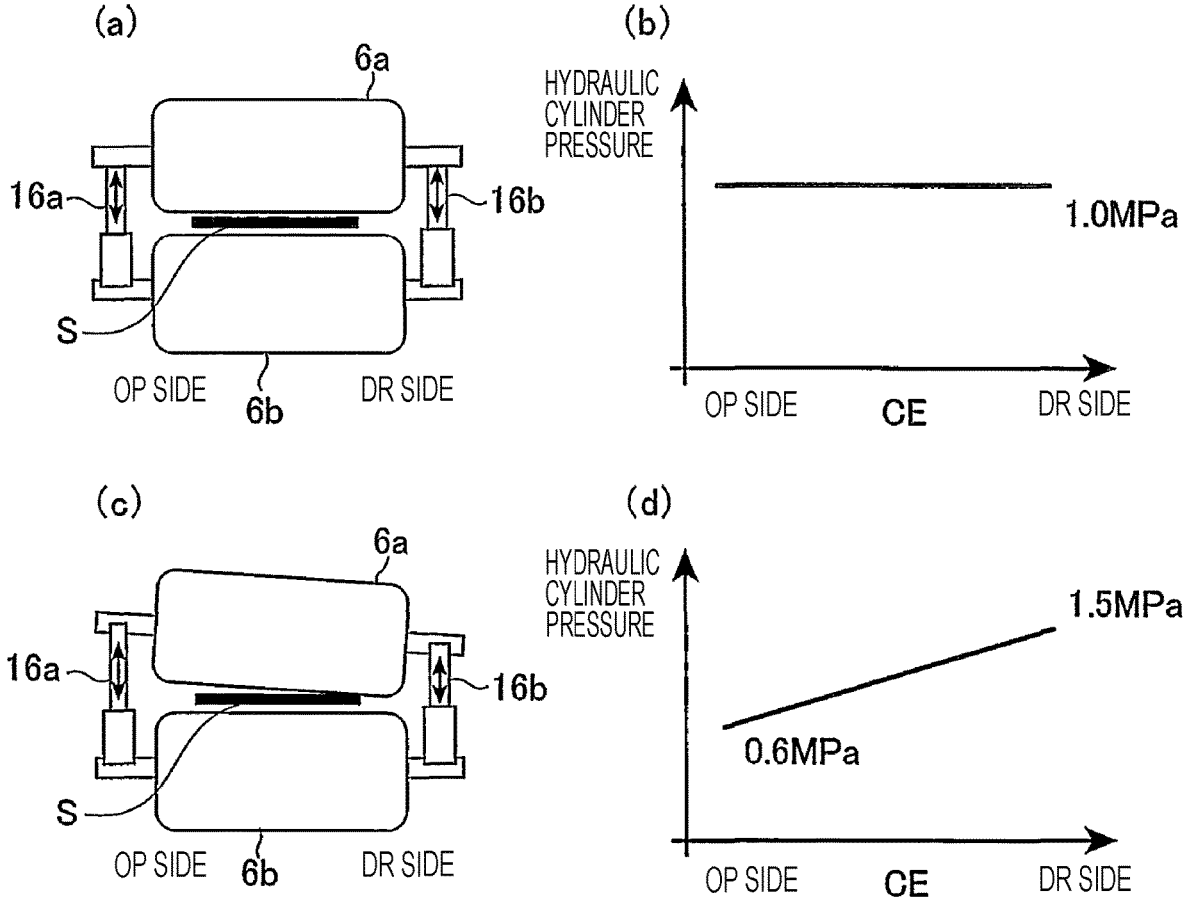
FIG. 5 is a schematic view explaining control of a rolling reduction amount by the holding mechanism in the bridle device according to an embodiment, and in FIG. 5, FIG. 5 (*a*) is a sectional view of the bridle device when seen from front in the case where snaking of a steel strip does not occur, FIG. 5 (*b*) is a distribution chart of pressure in the steel strip width direction in the case where snaking of the steel strip does not occur, FIG. 5 (*c*) is a sectional view of the bridle device when seen from front in the case where the pressure is increased on a drive side (DR side) during snaking of the steel strip to an operation side (OP side), and FIG. 5 (*d*) is a distribution chart of the pressure in the steel strip width direction in the case where the pressure is increased on the drive side (DR side) during snaking of the steel strip to the operation side (OP side).

Regarding rolling reduction control, specifically, the rolling reduction mechanism, that is, the hydraulic cylinders are operated to perform rolling reduction control. FIG. 5 is a schematic view explaining control of the rolling reduction amount by the holding mechanism in the bridle device according to an embodiment, schematically illustrating, for example, a case where the pressures of the hydraulic cylinders 16*a*, 16*b* are respectively controlled by setting, when the pressure of the one hydraulic cylinder 16*a* is 1, the pressure of the other hydraulic cylinder 16*b* in a range of 0.6 to 1.5. As illustrated in FIG. 5 (*a*), when snaking of the steel strip S does not occur, the upper and lower caterpillar members 6*a*, 6*b* pinch a steel sheet such that the pressure is uniform in the steel strip width direction as illustrated in FIG. 5 (*b*). For example, as illustrated in FIG. 5 (*c*), when snaking of the steel strip S occurs to an operation side (OP side), the hydraulic cylinders are adjusted so as to increase the pressure on a drive side (DR side) for correcting the snaking to the DR side. As illustrated in FIG. 5 (*d*), when the difference between the applied pressures is at the maximum, the OP side is 0.6 MPa and the DR side is 1.5 MPa.

According to the disclosed embodiments, rolling reduction amounts of the hydraulic cylinders (pressure balance) are automatically varied in accordance with the snaking amount of the steel strip S, thereby the pressure applied to the steel strip S when the steel strip S is pinched is made nonuniform in the steel strip width direction. Specifically, in the steel strip width direction, one of end portions in the steel strip width direction undergoes rolling reduction such that the rolling reduction amount is increased on the direction opposite to the snaking direction of the steel strip, thereby enabling correction of the snaking.

Figure 6:
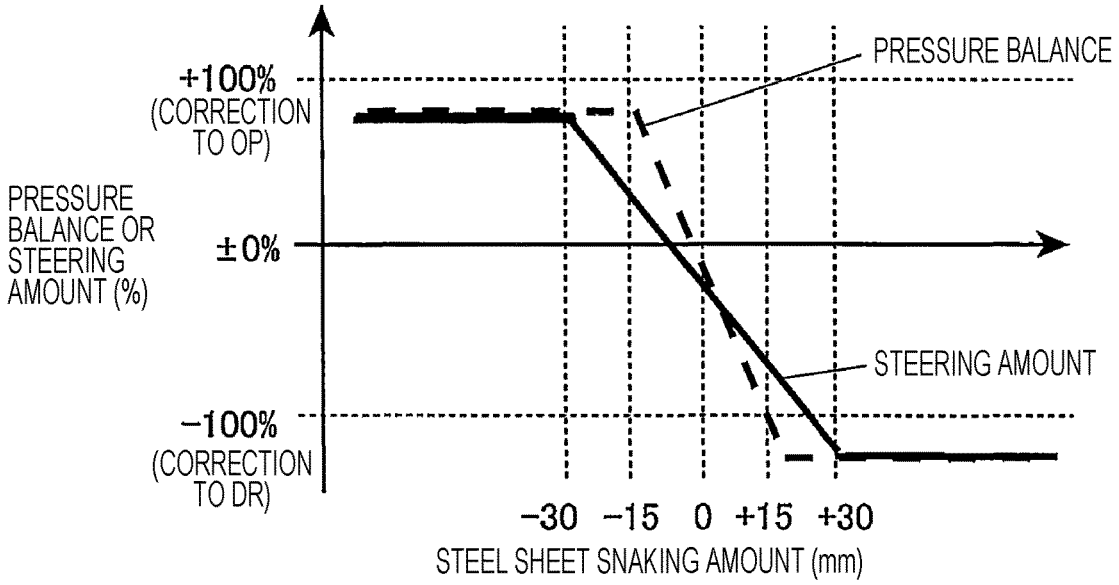
FIG. 6 illustrates an example of a control method plan for a steering amount and the rolling reduction amount in the bridle device according to an embodiment.

FIG. 6 illustrates an example of the control method plan according to an embodiment. According to a control method plan for the related-art bridle device, only the steering amount is automatically adjusted for the snaking amount of the steel strip S (solid line in FIG. 6). In the case of FIG. 6, when the snaking amount of ±30 mm is generated, the steering amount is at the maximum.

According to the disclosed embodiments, in addition to the steering amount, a function of correcting snaking by varying the pressure balance (rolling reduction amount) in the steel strip width direction is added (broken line in FIG. 6) so as to perform control in which the pressure balance in the width direction is at the maximum when, for example, the swelling amount is ±15 mm.

Regarding the control method plan according to the disclosed embodiments, testing for the ratio of the pressure balance to the steering amount was conducted. In the continuous siliconizing treatment facility illustrated in FIG. 1, siliconizing treatment was performed on the steel strip S having a thickness of 0.1 mm and a width of 640 mm (line speed: 30 mpm, line tension: 0.1 kg/mm$^2$). Snaking was corrected at the steering amount and the pressure balance listed in Table 1 (five patterns). The relationship between the steering amount and the pressure balance and results of the snaking correction are listed in Table 1. The steel sheet snaking amount in Table 1 are values corresponding to the horizontal axis of FIG. 6. The evaluations for the snaking amount are as described in a margin of Table 1.

TABLE 1

| Setting value of steering amount and pressure balance | | Control pattern (1) | (2) | (3) | (4) | (5) |
|---|---|---|---|---|---|---|
| Ratio of pressure balance (inclination) to steering amount (inclination) | | 1.0 times | 1.5 times | 2.0 times | 2.5 times | 3.0 times |
| steel sheet snaking amount | 0 mm | 0% | 0% | 0% | 0% | 0% |
| | | 0% | 0% | 0% | 0% | 0% |
| | 7.5 mm | 25% | 25% | 25% | 25% | 25% |
| | | 25% | 38% | 50% | 63% | 75% |
| | 15 mm | 50% | 50% | 50% | 50% | 50% |
| | | 50% | 75% | 100% | 100% | 100% |
| | 30 mm | 100% | 100% | 100% | 100% | 100% |
| | | 100% | 100% | 100% | 100% | 100% |
| | 50 mm | 100% | 100% | 100% | 100% | 100% |
| | | 100% | 100% | 100% | 100% | 100% |
| Evaluation (snaking amount) | | C | B | A | B | C |

A: The snaking amount is smaller than or equal to 15 mm.
B: The snaking amount is greater than 15 mm and smaller than 30 mm.
C: The snaking amount is greater than or equal to 30 mm.

In a pattern (1), the inclination of the pressure balance varies 1:1 relative to the inclination of the steering amount that varies in accordance with the steel sheet snaking amount. That is, it is indicated that the pressure balance relative to the steering amount increases from (1) to (5). Furthermore, the ratios listed in Table 1 represent output % of the steering amount or the pressure balance.

Figure 7:
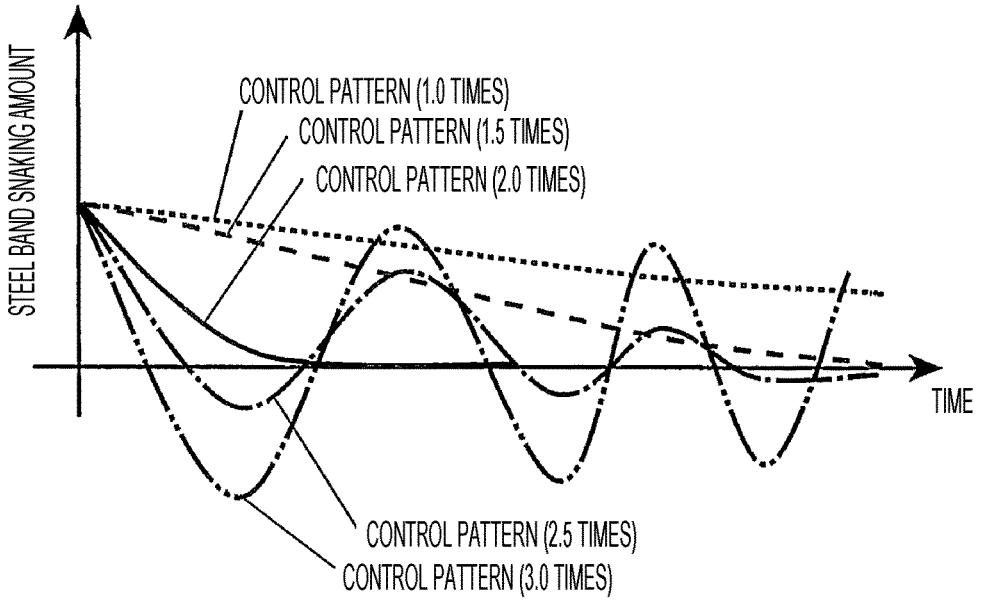
FIG. 7 schematically illustrates, on a control pattern-by-control pattern basis, how swelling is corrected over time from a state in which the steel strip is in a snaking state.

FIG. 7 is a conceptual view when snaking of the steel strip S is corrected in patterns listed in Table 1. FIG. 7 schematically illustrates how snaking is corrected over time from a state in which the steel strip S is in a snaking state, indicating the results in respective control patterns.

As in the cases of patterns (2), (3), and (4), when the ratio of the pressure balance to the steering amount is controlled so as to be in a range of 1.5 times to 2.5 times, snaking of the steel strip S can be effectively corrected. In the case of smaller than 1.5 times, when the snaking amount is small (snaking amount≤±10 mm), output of the pressure balance decreases. Thus, a capability of correction when snaking occurs is small, and a great amount of time is taken to snaking correction. In contrast, in the case of greater than 2.5 times, output of the pressure balance excessively increases even at a small snaking amount. This causes hunting of the pressure balance, and the device itself becomes the source of the occurrences of snaking. Thus, according to the disclosed embodiments, it is preferable that the ratio of the pressure balance to the steering amount be 1.5 times to 2.5 times.

From the above description, with the bridle device according to the disclosed embodiments, in combination with the related-art technique for the steering mechanism to move or swing in the width direction, the rolling reduction amount is made nonuniform in the steel strip width direction in pinching the steel strip by the rolling reduction mechanism. Thus, the snaking of the steel strip can be corrected to the side where the rolling reduction amount is high. As a result, even at a higher line speed than that of the related art, snaking of the steel strip that occurs when the steel strip is produced can be suppressed, and the steel strip can be produced with higher efficiency.

EXAMPLES

High-silicon steel strips were produced with a production facility for a high-silicon steel strip to which the bridle device according to the disclosed embodiments is applied and a production facility for a high-silicon steel strip to which the related-art bridle device is applied. Specifically, 3% Si steel strips having a thickness of 0.1 mm and a width of 640 mm were subjected to siliconizing treatment to produce 6.5% Si steel strips. Inner furnace tension of the steel strips was set to 0.1 kg/mm$^2$ by using a dancer roll serving as a tension applying means. The steel sheet snaking amount (steering movement amount) for the line speed during production was checked in the case of the bridle device according to the disclosed embodiments (with the pressure balance) and in the case of the related-art bridle device (without the pressure balance).

Figure 8:
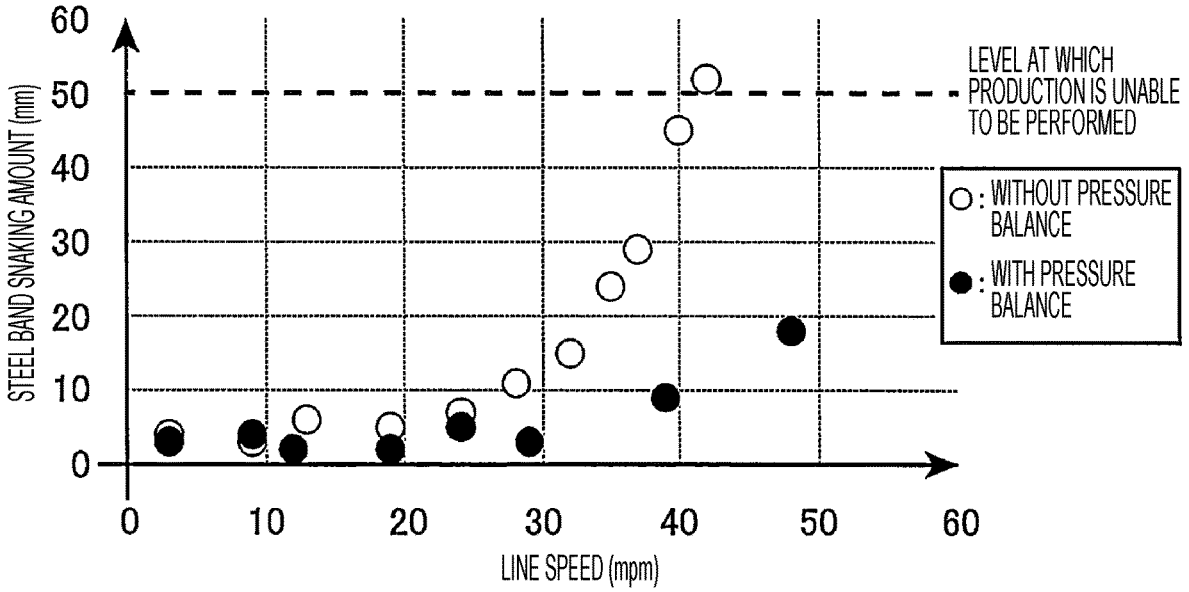
FIG. 8 illustrates the relationship between a line speed and a steel sheet snaking amount in an example.

The results are illustrated in FIG. 8.

In the related-art bridle device, snaking occurred when the line speed was about 40 mpm. The snaking amount increased to a level at which the production is unable to be performed, and the production was unable to be continued. In contrast, in the bridle device according to the disclosed embodiments, the snaking amount was within a tolerable range even when the line speed was 50 mpm, and the production was able to be continued.

The invention claimed is:

1. A bridle device comprising:

a pair of upper and lower rotatable endless belts or rotatable caterpillars configured to pinch a steel strip; and a rolling reduction mechanism comprising hydraulic cylinders provided on both sides in the steel strip width direction, the rolling reduction mechanism configured to apply pressure to both sides of the steel strip via the pair of upper and lower rotatable endless belts or rotatable caterpillars, wherein the bridle device is configured to move or swing in a steel strip width direction based on a steering amount of the bridle device, the rolling reduction mechanism is configured to control rolling reduction on a pinched portion of the steel strip with a pressure balance among the hydraulic cylinders by increasing a pressure of the hydraulic cylinder provided on one of the sides of the steel strip, and the steering amount of the bridle device and the pressure balance among the hydraulic cylinders are determined in accordance with a snaking amount of the steel strip.

2. The bridle device according to claim 1, wherein the rolling reduction mechanism is configured to control rolling reduction so as to increase a rolling reduction amount in a direction opposite to a snaking direction of the steel strip.

3. The bridle device according to claim 1, wherein a ratio of an inclination amount of the pressure balance among the hydraulic cylinders to an inclination amount of the steering amount of the bridle device is in a range of 1.5 times to 2.5 times.

4. A method for controlling snaking of a steel strip, the method comprising controlling snaking of the steel strip by moving or swinging the bridle device and controlling the rolling reduction on the pinched portion of the steel strip according to claim 1 based on the steering amount and the pressure balance among the hydraulic cylinders.

5. A method for producing a corrected steel strip, the method comprising controlling snaking of the steel strip by moving or swinging the bridle device and controlling the rolling reduction on the pinched portion of the steel strip according to claim 1 based on the steering amount and the pressure balance among the hydraulic cylinders to produce the corrected steel strip.

6. The bridle device according to claim 2, wherein a ratio of an inclination amount of the pressure balance among the hydraulic cylinders to an inclination amount of the steering amount of the bridle device is in a range of 1.5 times to 2.5 times.

7. A method for controlling snaking of a steel strip, the method comprising controlling snaking of the steel strip by moving or swinging the bridle device and controlling the rolling reduction on the pinched portion of the steel strip according to claim 2 based on the steering amount and the pressure balance among the hydraulic cylinders.

8. A method for controlling snaking of a steel strip, the method comprising controlling snaking of the steel strip by moving or swinging the bridle device and controlling the rolling reduction on the pinched portion of the steel strip according to claim 3 based on the steering amount and the pressure balance among the hydraulic cylinders.

9. A method for controlling snaking of a steel strip, the method comprising controlling snaking of the steel strip by moving or swinging the bridle device and controlling the rolling reduction on the pinched portion of the steel strip according to claim 6 based on the steering amount and the pressure balance among the hydraulic cylinders.

10. A method for producing a corrected steel strip, the method comprising controlling snaking of the steel strip by moving or swinging the bridle device and controlling the rolling reduction on the pinched portion of the steel strip according to claim 2 based on the steering amount and the pressure balance among the hydraulic cylinders to produce the corrected steel strip.

11. A method for producing a corrected steel strip, the method comprising controlling snaking of the steel strip by moving or swinging the bridle device and controlling the rolling reduction on the pinched portion of the steel strip according to claim 3 based on the steering amount and the pressure balance among the hydraulic cylinders to produce the corrected steel strip.

12. A method for producing a corrected steel strip, the method comprising controlling snaking of the steel strip by moving or swinging the bridle device and controlling the rolling reduction on the pinched portion of the steel strip according to claim 6 based on the steering amount and the pressure balance among the hydraulic cylinders to produce the corrected steel strip.

* * * * *